United States Patent [19]

Lewins et al.

[11] Patent Number: 4,976,495

[45] Date of Patent: Dec. 11, 1990

[54] METHOD AND APPARATUS FOR STEERING A MINING MACHINE CUTTER

[75] Inventors: Foster Lewins, Mickleover; Timothy S. Gammons, Ripley, both of England

[73] Assignee: Coal Industry (Patents) Limited, London, England

[21] Appl. No.: 390,831

[22] Filed: Aug. 8, 1989

[30] Foreign Application Priority Data

Aug. 11, 1988 [GB] United Kingdom ..... 88 19056.6

[51] Int. Cl.[5] ..... E21C 35/12; E21C 35/24

[52] U.S. Cl. ..... 299/1; 33/367; 340/689

[58] Field of Search ..... 299/1, 42; 33/1 PT, 33/366, 367; 116/227; 340/689; 73/290 V

[56] References Cited

U.S. PATENT DOCUMENTS 4,371,209 2/1983 Alford et al. ..... 299/1
4,554,535 11/1985 Floris et al. ..... 340/689
4,643,482 2/1987 Wolfenden ..... 299/1
4,822,105 4/1989 Yamada et al. ..... 299/1

FOREIGN PATENT DOCUMENTS 2027548 2/1980 United Kingdom ..... 299/1
2144466 3/1985 United Kingdom .

*Primary Examiner*—Ramon S. Britts
*Assistant Examiner*—David J. Bagnell
*Attorney, Agent, or Firm*—James C. Wray

[57] ABSTRACT

The trailing drum of a double-ended ranging drum shearer is steered in a seam by producing an algorithm which determines, as a result of information derived from signals from the machine dependant on its tilt, direction and amount of movement along a face being cut. The height of the leading drum is used as a reference from which to determine the optimum position of the trailing drum in order that a constant quality of desired mined material is obtained.

7 Claims, 1 Drawing Sheet

METHOD AND APPARATUS FOR STEERING A MINING MACHINE CUTTER

BACKGROUND OF THE INVENTION

1. Field of the Invention

This invention relates to a method of steering a mining machine cutter in which the mining machine is of the kind having a body arranged to the progressed along a mineral face being cut, the body having at either end a ranging arm pivotally mounted on the body and each arm carrying a rotatable cutting drum. This kind of machine is known as a double-ended ranging drum shearer.

2. Prior Art

Such a machine carries a plurality of sensor means mounted on the machine which are adapted to measure different parameters of the mining operation and to generate electrical signals representative of said parameters. For example, a first of said sensor means may be arranged to measure along the face angle or tilt of the machine, second sensor means may be arranged to measure the movement and direction of the machine and a third of said sensor means may be arranged to measure the positions of the leading and trailing ranging arms with respect to the machine. The invention also encompasses apparatus for use with the method.

In mineral cutting operations, particularly those concerning coal, it is necessary to steer a cutting machine to enable the maximum efficiency of operation to be achieved by ensuring that only the desired mineral, i.e. coal, is cut and the machine does not wander into strata on either side of the coal. In order to do this, it is normal to leave a few inches of the material being cut to form a roof and floor so that any minor variations in the path of the cutting machine only varies the thickness of the roof and floor left and does not cut into the adjoining strata.

Many means of cutting and extracting wanted mineral are known, but the most commonly used form, particularly for winning coal, is to use a ranging drum machine having ranging arms at either end where a cutting drum having a plurality of cutting picks is rotated at the end of each ranging arm which is pivotally secured to the body of a machine. The body of the machine is pulled along a face and each rotating drum cuts material from the face.

This type of machine is steered to enable the drum always to cut within the seam by adjusting the pivotal control of the ranging arms. This can be done manually by skilled operators who watch the progress of the drum and the seam, but generally automatic means are preferred since the creation of dust and water sprays can impair the vision of the drum by the operators.

Automatic sensing of the roof has been proposed and is operated in a large number of installations. In one form of automatic sensing a sensor device is carried on the machine and this measures gamma rays emitted from the roof of the seam being cut and a count of these rays attenuated by the amount of wanted material remaining on the roof is picked up by the sensor device on the machine and this produces a control signal which is inversely proportional to roof coal thickness. This control signal can be used with other signals to control the angle at which the ranging arm is set so as to ensure a substantially constant thickness of material left on the roof. A second sensor device can be mounted in a roof following position on the ranging arm of the machine physically to engage the roof which has previously been cut. This sensor device produces a signal to determine the height of the cutting drum with respect to the previously exposed roof. A third sensor device can be incorporated to measure the angle of the machine in face advance. This device produces a signal related to the said angle and is used to give stability to the system.

At present double-ended ranging drum shearers use the sensor devices to control the shearer so that the leading drum leaves the desired thickness of wanted material (coal) on the roof and the trailing drum, which is offset from the roof, cuts a constant extraction. Since there is a requirement to position the trailing drum some distance from the roof, the roof follower arms previously used have all been of a relatively long nature and the end of the arm, carrying a wear area which abuts the roof, is located behind the drum so that it is giving instructions to the steering control to follow as closely as possible the passage of the drum. Unfortunately the long roof follower arm is prone to damage producing erroneous reading. The use of a shorter follower arm has previously been proposed in our previous Patent Specification No. 2 121 852 where a small pivoted follower arm is located on the ranging arm itself in the vicinity of the cutting drum.

SUMMARY OF THE INVENTION

It is an object of the present invention to provide an improved method of steering the trailing drum of a mining machine which gives an accurate path for both cutting drums of the machine keeping it in the material being cut. It is also an object to provide apparatus which enables the method t be carried out.

According to the present invention, there is provided a method of steering the trailing drum of a double-ended mining machine in which the mining machine is of the kind having a body arranged to be progressed along a mineral face being cut, the body having at either end a ranging arm pivotally mounted on the body and each arm carrying a rotatable cutting drum, one drum being a leading drum and the other a trailing drum, a plurality of sensor means being mounted on the machine and being adapted to measure different parameters of the mining operation and to generate electrical signals representative of said parameters, a first of said sensor means being arranged to measure the along face angle or tilt of the machine, second sensor means being arranged to measure the movement and direction of the machine and a third of said sensor means being arranged to measure the positions of the leading one of said arms and a trailing one of said arms with respect to the machine; comprising establishing from the first and second sensor means, electrical signals indicating the direction and movement of the machine and the position of the machine relative to a datum line, establishing from an electrical signal from the third sensor means and by calculation the height of the cut roof above the datum line, and storing information derived from said signals in store means; subsequently feeding the output signal to control means of the trailing drum to operate said control means to alter the position of the trailing drum, so as to maintain the steering movement of the trailing drum such that it cuts a floor parallel to the roof cut previously by the leading drum.

The invention also includes a transducer arrangement for use with the method which comprises a pair of normally vertical parallel tubes joined at their lower ends by a horizontal tube and with a liquid filling the horizontal tube and part of the vertical tubes, and including a separate transducer at the top of each vertical tube.

The separate transducer are preferably ultrasonic and the liquid is preferably of a medium viscosity.

These and further other objects and features of the invention are apparent in the disclosure, which includes the above and ongoing written specification, including the claims and the drawings.

DETAILED DESCRIPTION OF THE INVENTION

Figure 1:
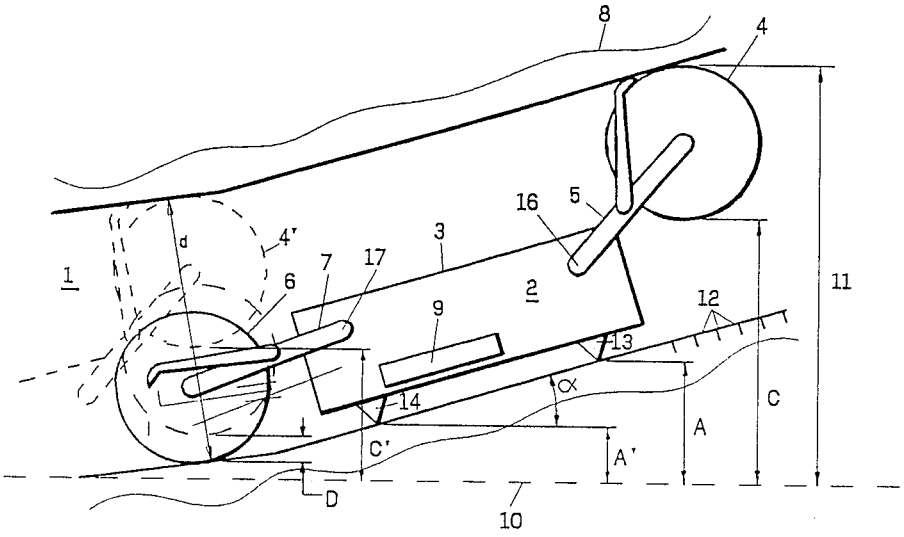
FIG. 1 is a schematic view showing a construction of a double-ended ranging drum shearer operating in a coal seam and indicated diagrammatically calculations which determine the trailing boom height.

Referring now to FIG. 1 of the drawings, this shows a coal seam (1) in a coal mine. The seam is determined to undulate horizontally and a double-ended ranging drum shearer machine indicated generally at (2) is positioned in the seam to operate on a longwall advancing system. The machine (2) comprises a machine body (3) having a leading drum (4) on a ranging arm or pivotal boom (5) attached to the front end of the body (3). A trailing drum (6) on a ranging arm or pivotal boom (7) is connected to the rear of the body (3).

Each of the drums (4) and (6) are rotatable and have a scroll of picks mounted on vanes which when rotated cut into the face of the seam (1). The leading drum (4) cuts the top portion of the seam and the trailing drum (6) extracts the remainder. The leading drum (4) is positioned either manually or automatically by using existing techniques near to the upper seam boundary (8) of the adjacent strata. Similarly the trailing drum (6) is positioned by use of the invention a distance (d) below the roof of the previous cut. The position of the leading drum on its previous cut is shown at 4' when at the location of the trailing drum on this cut.

The cutting machine is hauled along an armoured conveyor (not shown) in a conventional manner as it cuts.

A transducer (9) is included in the body of the machine (3) to measure along the face tilt (AFT) of the machine (3). The AFT measurement is used to calculate the body height (A) of a leading shoe (13) above a horizontal datum line (10) at its point of contact with the armoured conveyor as it passes along the face. The height of a trailing shoe (14) above the datum line (10) is indicated by A'. The transducer (9) produces an electrical signal proportional to the tilt of the machine. This signal is known as the AFT signal since it indicates along the face tilt. The position and direction of the travel of the machine (2) along the face is also determined by a transducer (not shown) known as the machine movement and direction detector (MMADD) which gives an output signal related to the machine movement and direction. This movement is recorded in incremental units as indicated at (12). The AFT signals react to variations from a set value with respect to the horizontal datum line (10) which is set up when the machine is first installed. The roof height (11) at the cutting point of the leading drum is also determined with reference to this datum line (10) by the use of a signal generated by a transducer (16) operated as the leading drum ranging arm (5) rotates.

The machine is set into the face with the leading drum cutting the top of the seam and the trailing drum at the bottom of the seam. As the machine moves along the face, the distance of the machine from the face end is recorded incremently by counting the number of distance increments (12), and against this, is also recorded the height (A) of the leading shoe (13) and the roof height (11) above the datum (10).

This information is stored. This stored information is used to establish the automatic steering of the trailing drum.

The trailing drum (6) is positioned by using the information from the store of body heights of shoes (13, 14) and roof heights according to shoe and drum positions along the face with reference to the datum line and information is fed to transducer (17) to alter the position of ranging arm (7) to ensure a correct distance (d) of the base of the drum (6) below the roof.

An assessment can now be made to how an algorithm is derived to determine the trailing boom height.

The maingate drum center is the reference point for all measurements along the face. These measurements are taken with respect to the maingate center line.

In the Figure, the value of (A) represents the height of a leading shoe (13), pivoted about the trailing shoe (14), above the horizontal datum line (10) and is determined as follows:

$$A = (\textit{distance between shoes}\ (13, 14) \times \sin AFT) + A'$$

The value of A' represents the height of the trailing shoe (14) retrieved from the information store of when the leading shoe (13) was at that position along the face, that is the value A offset by the distance between shoes (13, 14). N.B. If the distance between shoes is not an integer multiple of MMADD increments then the vertical height of A' will be given by:

$$A'actual = A' + h$$

where h=sin $\alpha$x fractional part of excess MMADD increment and $\alpha = tan^{-1}\ [(A+1)' - A'/excess\ MMADD\ increment]$ for example, if A'=500 mm, A=550 mm, one MMADD increment=160 mm and the distance between shoes=7.5 MMADD increments then, $\alpha = tan^{-1}\ [(550-500)/(160\times 0.5)] = 32$ *degrees,* $h = sin\ 32\times 80 = 42.4$ *mm* hence, $A'actual = 500 + 42.4 = 542.4$ *mm.*

The value of C represents the base of the leading drum (4) above the horizontal datum line (10) and is calculated in the following manner:

$C = A + (arm\ length' \times \sin AFT)$ + leading boom height at that point where arm length' is the arm length modified by a fixed distance in order to take account of the fact that the shearer is pivoted about its respective shoe (13), rather than a trunnion center.

The value of C' represents the height, above the horizontal datum line (10), that the base of the trailing drum (6) is required to achieve in order to mirror the leading drum profile. This value would of course offset vertically by any extraction control required. It can be seen that C' is a repeat, value of C offset along the face by the distance between drum centers.

The value of D represents the calculated change in trailing drum position from its reference position where the base of the drum would normally be level with the base of the pans, and is determined in the following manner to produce the correct extraction control necessary, taking into account the profile cut by the leading drum at that point on the face.

$$D=C-[A'+(arm\ length'\times sin\ AFT)]-(extraction-drum\ dia.)$$

The AFT is deemed positive if the leading shoe (13) is higher than the trailing shoe (14), consequently on a double ended ranging drum shearer single pass operation the AFT reverses sign when the haulage reverses.

It will be appreciated that in accordance with established double-ended ranging drum shearer practice on a return cut the previous trailing drum becomes the leading drum and the invention is applied to the new trailing drum exactly the same as in the previous cut.

Figure 2:
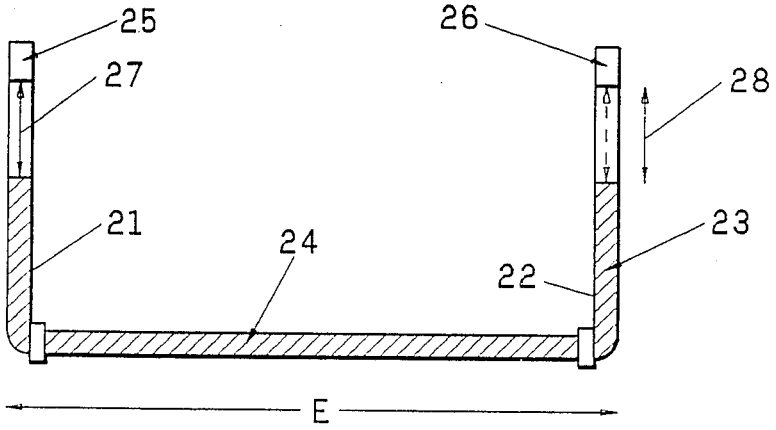
FIG. 2 illustrates the transducer arrangement for use with the apparatus of FIG. 1.

In order that the steering is achieved with the maximum degree of accuracy it is necessary to be able to take all measurements with as much precision as possible. This is particularly important in measuring the angle $\alpha$ for the along face tilt calculation. A suitable transducer arrangement is shown in FIG. 2 to which reference is now made.

The arrangement comprises a pair of parallel tubes 21, 22 carrying a liquid 23 of medium viscosity. The lower ends of the tubes are bent and are joined by a flexible connecting hose 24. Tube 21 has an ultrasonic transducer 25 fixed at its uppermost end and tube 22 has a corresponding transducer 26 at its uppermost end. The two tubes are spaced by a measured distance E which in practice will be of the order of the distance between the shoes 13, 14.

The arrangement is mounted in a protected position as the machine body 2 and with the machine in a horizontal plane the distance between the transducers 25, 26 at the liquid surface in the respective tubes 21, 22 is measured as 27, 28 respectively and the transducers each produce an electrical signal proportional to the distance and of equal volume.

As the arrangement begins to tilt the distances 27, 28 begin to alter distance 28 becoming less than 27 as tube 22 rises relative to tube 21. This causes the transducers to give different signals and these signals can easily be assessed by established mathmatical means to produce the angle of tilt $\alpha$.

The liquid 23 in the hose 24 and tubes 21, 22 is chosen to have not too high a viscosity to avoid there being a long time delay in establishing the angle. It must, of course, not have too low a viscosity otherwise it will give a constantly varying output from the transducers due t the effect of machine vibrations.

We claim:

1. A method of steering a trailing drum of a double-ended mining machine in which the mining machine is of the kind having a body arranged to be progressed along a mineral face being cut, the body having at either end a ranging arm pivotally mounted on the body and each arm carrying a rotatable cutting drum, one drum being a leading drum or the other the trailing drum, a plurality of sensor means being mounted on the machine and being adapted to measure different parameters of the mining operation and to generate electrical signals representative of said parameters, a first of said sensor means being arranged to measure the along face angle or tilt of the machine, second sensor means being arranged to measure the movement and direction of the machine and a third of said sensor means being arranged to measure the positions of the leading one of said arms and a trailing one of said arms with respect to the machine; comprising establishing from the first and second sensor means, electrical signals indicating the direction and movement of the machine and the position of the machine relative to a datum line, establishing from an electrical signal from the third sensor means, and by calculation, the height of the cut roof above the datum line, and storing information derived from said signals in store means: subsequently feeding an output signal to control means of the trailing drum to operate said control means to alter the position of the trailing drum, so as to maintain the steering movement of the trailing drum such that it cuts a floor parallel to the roof cut previously by the leading drum.

2. A method as claimed in claim 1 wherein the angle of tilt along the face is denoted by $\alpha$, the height of a leading shoe of the machine above a datum is denoted by A and the height of the trailing shoe above the same datum by A' and the value of A is calculated from the formula:

$$A=(distance\ between\ shoes\times sin\ \alpha)+A'$$

3. A method as claimed in claim 2 wherein the height C of the base of the leading drum above the datum is calculated from the formula:

$C=A+(arm\ length'\times sin\alpha)$ plus the height of the base of the leading drum determined by a transducer connected to measure the angle of movement of the boom carrying the leading drum.

4. A method as claimed in claim 3 wherein the height C' of the trailing drum above the datum is determined from the same formula as for determining the value of C but with a correction for the distance between the of the leading and trailing drums.

5. A double-ended mining machine comprising a body range to be progressed along a mineral face being cut, the body having at either end a ranging arm pivotally mounted on the body and each carrying a rotatable cutting drum, one drum being a leading drum or the other a trailing drum, a plurality of sensor means being mounted on the machine and being adapted to measure different parameters of the mining operation and to generate electrical signals representative of aid parameters, and a transducer arrangement, wherein the transducer arrangement has a pair of normally vertical parallel tubes joined at their lower ends by a horizontal tube and with a liquid filling the horizontal tube and part of the vertical tubes, and including a separate transducer at the top of each vertical tube.

6. An arrangement as claimed in claim 5 wherein the transducers are ultrasonic transducers.

7. An arrangement as claimed in claim 5 wherein the liquid is of a medium viscosity.

* * * * *